US010549134B1

(12) United States Patent
Stawychny

(10) Patent No.: US 10,549,134 B1
(45) Date of Patent: Feb. 4, 2020

(54) TIE-OFF ANCHOR DEVICE WITH MANUALLY SECURED WEIGHTS

(71) Applicant: Steve M. Stawychny, Hoffman Estates, IL (US)

(72) Inventor: Steve M. Stawychny, Hoffman Estates, IL (US)

(73) Assignee: SWITCH RAIL SAFETY SYSTEMS, LLC, Bensenville, IL (US)

( * ) Notice: Subject to any disclaimer, the term of this patent is extended or adjusted under 35 U.S.C. 154(b) by 0 days.

(21) Appl. No.: 16/231,730

(22) Filed: Dec. 24, 2018

(51) Int. Cl.
*A62B 35/00* (2006.01)
*E04G 21/32* (2006.01)

(52) U.S. Cl.
CPC ..... *A62B 35/0068* (2013.01); *E04G 21/3276* (2013.01)

(58) Field of Classification Search
CPC ..... A62B 35/0068; E04G 21/3276
USPC ..... 182/3, 45, 190
See application file for complete search history.

(56) References Cited

U.S. PATENT DOCUMENTS 8,312,966 B1 * 11/2012 Guthrie ..... E04G 5/045 182/3
8,646,575 B1 * 2/2014 Guthrie ..... A62B 35/0068 182/3
2007/0267249 A1 * 11/2007 Cullen ..... A47L 3/00 182/45
2009/0321184 A1 * 12/2009 Hamilton ..... A62B 99/00 182/3
2013/0299279 A1 * 11/2013 Pierce ..... A62B 35/0068 182/190
2013/0313043 A1 * 11/2013 Lallier ..... E04G 3/265 182/45
2014/0013700 A1 * 1/2014 Pierce ..... A62B 35/0068 52/698
2016/0356050 A1 * 12/2016 Tsaousis ..... E04G 21/3242

FOREIGN PATENT DOCUMENTS

GB 2330169 * 9/1998

OTHER PUBLICATIONS

Depiction of a Tie-Off Anchor Device without manually secured weights. The device is illustrated at the SwitchRail website: https://www.switchrail.com/non-penetrating-systems-3/. The device without manually secured weights first appeared on the SwitchRail website on Apr. 25, 2013.

* cited by examiner

*Primary Examiner* — Joshua K Ihezie
(74) *Attorney, Agent, or Firm* — Donald Flaynik

(57) ABSTRACT

A tie-off anchor device having manually secured weight members includes a plurality of base plates detachably secured to a hub portion. The base plates have a predetermined quantity of weight members detachably secured to each of the base plates. The hub portion and base plates are disposed upon a preselected structure. A plate end of an arm member is vertically secured to a top wall of each of the base plates, and a knob retaining member is secured to a top end portion of each of the plate ends of each of the arm members. A weight retaining member is detachably secured, via a knob member, to each of the knob retaining members, and the weight retaining members detachably secure a predetermined quantity of weight members to a top wall of each of the plurality of base plates.

17 Claims, 6 Drawing Sheets

TIE-OFF ANCHOR DEVICE WITH MANUALLY SECURED WEIGHTS

BACKGROUND OF THE INVENTION

1. Field of the Invention

The present invention relates generally to a tie-off anchor device for providing safety for a person standing on an elevated structure, and more particularly, to a safety tool that includes a member for receiving a detachable strap secured to a person standing on an elevated structure, the safety tool further including manually detachable weight members that can be manually secured to a selected member of the tool.

2. Background of the Prior Art

A myriad of prior art fall protection tie-off anchor devices for person standing and/or working on an elevated structure are commercially available. The prior art fall protection devices include configurations having relatively heavy portions or weight members secured to and distally positioned from a hub portion of the configuration. The hub member and prior art weight members ultimately "gripping" a portion of the structure that is relatively near where the user is working or standing. To enable prior art fall protection devices to be manually transported up to elevated platforms or structures, the weight members must be separated from a hub member, carried up to an elevated structure, whereupon, the hub member is disposed upon a selected portion of the elevated structure, and the weight members are then secured to the hub member via mechanical means that typically include bolt and nuts that require an excessive amount of manual labor time. Further, when prior art fall protection devices are carried down from an elevated structure, the nut and bolt combinations must be manually separated, and the hub member, weight members and nut and bolt connectors must be manually carried to a lower elevation or ground level.

The problem with the prior art fall protection devices is the assembly time and the methods used by persons of the prior art devices for reducing the assembly time and/or reducing the quantity of weights that must be carried up to the structure that the person is standing upon. To reduce the manual assembly time for the prior art fall protection devices, an assembly of hub and weight members is provided that includes a reduced quantity of weight members that is less than the minimum quantity of weight members required to maintain safety for the person strapped to the hub member when standing or working upon an elevated structure.

There is a need for a tie-off anchor device that includes manually secured weight members that are relatively easy to attach and remove from a member of the device. Further, there is a need for a tie-off anchor device that will not function and cannot be used unless a minimum quantity of weight members are included with the tie-off anchor device that will be detachably secured to a person standing on an elevated structure.

SUMMARY OF THE INVENTION

It is a principal object of the present invention is to provide a single man tie-off anchor device having manually secured weight members. A feature of the device is a plurality of weight members detachably and manually secured to cooperating base plates via a knob member.

Another feature of the device is a knob retaining member integrally secured to an inner portion of a top end portion of a plate end of an arm member detachably secured to a hub member. An advantage of the device is that the knob member can be manually rotated to insert into or extract from the knob retaining member to ultimately secure or separate the plurality of weight members from respective base plates.

Yet another object of the present invention is to provide a device that assembles and disassembles in a relatively short time frame. A feature of the device is a hub end of the arm member having a configuration and dimensions that allows the hub end to snugly encase a cooperating hub conduit member integrally secured to a base portion of the hub member. without using any bolts, nuts or similar fasteners. An advantage of the device is that no fasteners are used to assemble the device, thereby virtually eliminating the assembly time to secure the base plates to the hub member.

Still another object of the present invention is to provide a device that secures and separates the weight members to and from the base plates in a relatively short time frame. A feature of the device is a weight retaining member that allows a shank portion of the knob member to extend through the retaining member and rotationally insert into and extract from the knob retaining member. Another feature of the device is a portion of the knob member maintaining continual engagement with a top wall of the weight retaining member when the shank portion of the knob member is forcibly inserted into the knob retaining member. Yet another feature of the device is a bottom edge portion of the weight retaining member and securing arms integrally joined to the bottom edge forcibly engaging a top wall of a top weight member to urge the weight members upon the base plates. An advantage of the device is that no fasteners are used to secure the weight members upon the base plates, thereby substantially reducing the time to dispose and secure the weight members upon the base plates.

Another object of the present invention is to maintain a predetermined quantity of weight members upon the base plates. A feature of the device is providing configurations and dimensions for the plate end, weight members, weight retaining member, knob member and knob retaining member that cooperate to secure a minimum quantity of weight members upon the base plates. An advantage of the device is that if a quantity of weight members disposed upon any base plate is less than a preselected safe quantity, the weight retaining member will not engage the top wall of the top weight member, resulting in the weight members not being secured to the respective base plate, which is an unacceptable condition that will prevent the use of the device until more weight members are added to enable the respective weight retaining member to engage the top wall of the top weight member and secure all weight members to the respective base plate.

In brief, the tie-off anchor device with manually secured weights includes:

a plurality of base plates detachably secured to a hub portion, the plurality of base plates have a predetermined quantity of weight members detachably secured each of the plurality of base plates, the hub portion and the plurality of base plates are ultimately disposed upon a preselected structure;

a plurality of arm members each having a plate end perpendicularly secured to a top wall of each of the plurality of base plates, each arm member has a hub end detachably secured to a hub conduit member integrally joined to a top wall of a base portion of the hub member, each arm member has an extension portion integrally joined to each of the plate ends and the hub ends;

a plurality of knob retaining members secured to an inner portion of a top end portion of each of the plurality of plate ends of the plurality of arm members;

a plurality of weight retaining members detachably secured to the plurality of knob retaining members, the plurality of weight retaining members detachably securing a predetermined quantity of weight members to the plurality of base plates; and a plurality of knob members for manually securing the plurality of weight retaining members to the plurality of knob retaining members such that the weight retaining members forcibly engage top walls of top weight members, thereby detachably securing a predetermined quantity of weights upon a top wall of each of the plurality of base plates; whereby, a person wearing a harness can secure the harness to the hub portion of the device and prevent the person from falling from the preselected structure and engaging a lower elevation surface.

BRIEF DESCRIPTION OF THE DRAWINGS

Objects, advantages and novel features of the present invention, as well as details of an illustrative embodiment thereof, will be understood from the following detailed description and attached drawings, wherein.

DESCRIPTION OF THE PREFERRED EMBODIMENT

Figure 1:
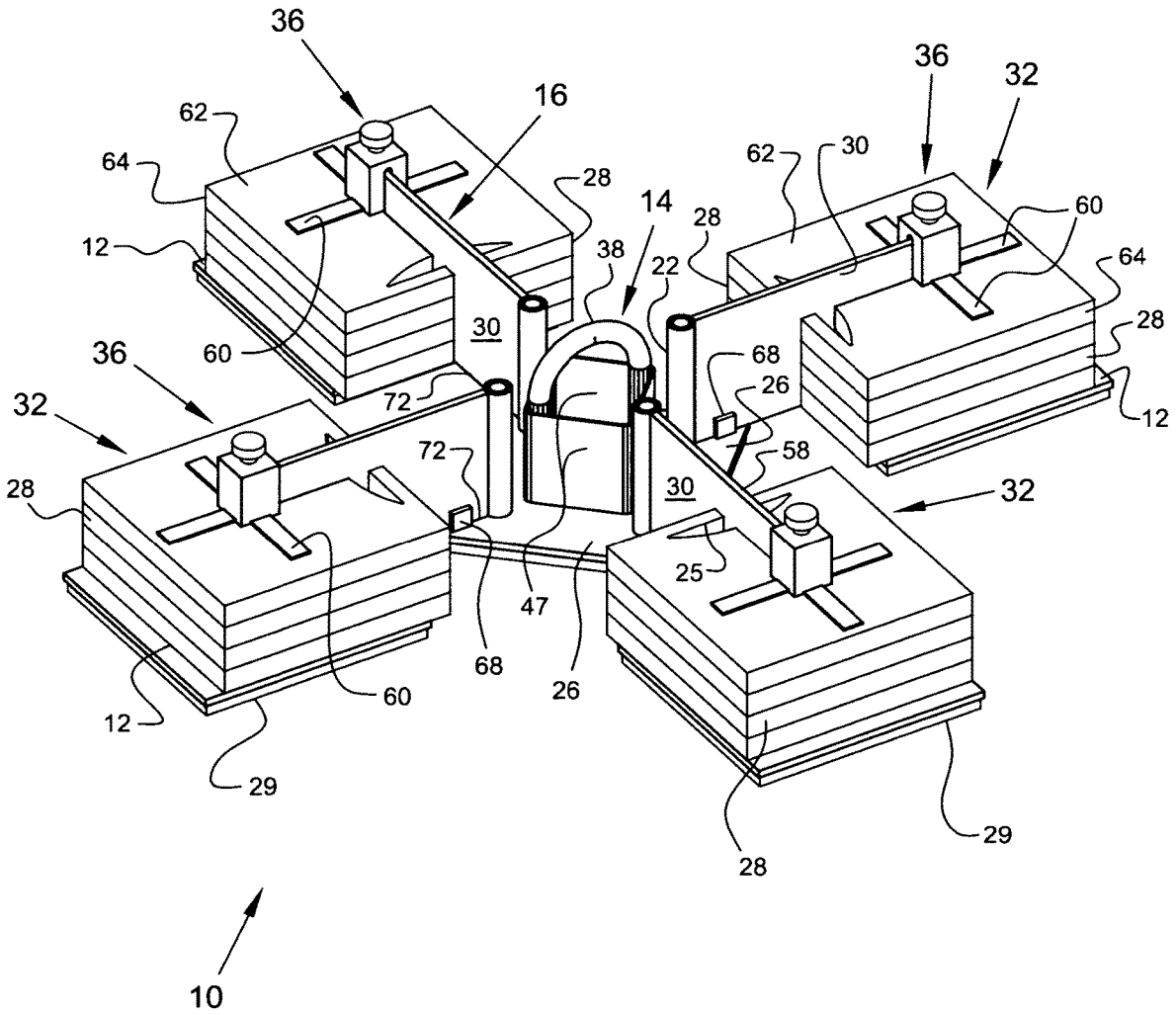
FIG. 1 is a top perspective view of a tie-off anchor device with manually secured weight members in accordance with the present invention.
Figure 2:
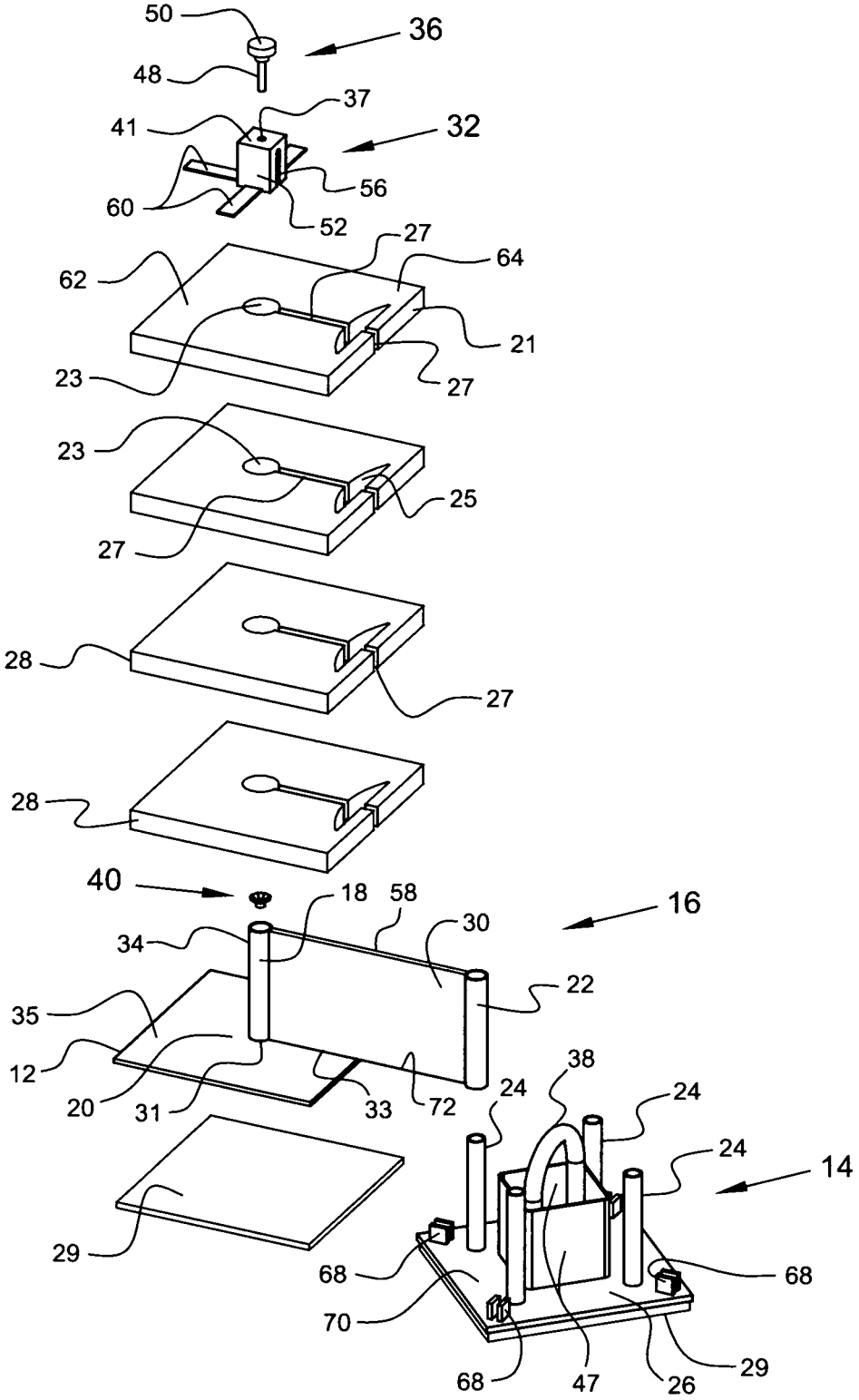
FIG. 2 is an exploded top perspective view of a hub member of the device of FIG. 1, but with only one arm member-weight member assembly depicted.

Referring to the figures, a tie-off anchor device having manually secured weights in accordance with the present invention is denoted as numeral 10. The device 10 is manufactured from steel or similar non-deformable material and includes a predetermined quantity of base plates 12 (preferably four) detachably secured to a hub member 14 via an arm member 16 having a cylindrically configured conduit forming a plate end 18 integrally secured, via welding or similar means, to a center portion 20 of a base plate 12, and a hub end 22 detachably secured to a hub conduit member 24 integrally secured to a base portion 26 of the hub member 14. The base plates 12 have a predetermined quantity of weight members 28 (preferably four) disposed upon each base plate 12 such that each group of four base plates 12 are detachably secured to each of the arm members 16. The preferred material to fabricate the weight members 28 is a relatively rigid rubber, although alternative materials can be substituted for the rubber such as metal. The arm member 16 further includes an extension portion 30 integrally joined to the plate and hub ends 18 and 22 to promote the separation of the base plates 12 from the hub conduit member 24 and the hub member 14 a predetermined distance. The base plates 12 and hub member 14 each include a rubber bottom grip 29 with a knurled surface to secure the positions of the base plates and hub member 12 and 14 when disposed upon a preselected structure (not depicted).

The plate end 16 and the extension portion 30 of the arm member 16 include respective bottom edge portions 31 and 33 each being perpendicularly secured to a top wall 35 of each of the base plates 12. A channel configured weight retaining member 32 is detachably secured to a top end portion 34 of each plate end 18 of each arm member 16. The weight retaining members 32 detachably secure respective weight members 28 to respective base plates 12 and corresponding plate ends 18 via a knob member 36 having a shank portion 48 that inserts through an orifice 37 in a top wall 41 of the weight retaining member 32. A handle portion 50 of the knob member 36 is then manually rotated to rotationally insert the shank portion 48 into a knob retaining member 40 disposed in the top end portion 34 of each plate end 18.

The weight members 28 include a plate end aperture 23 for removably receiving the plate end 18 of the arm member 16, a handle aperture 25 for promoting the manual lifting of a weight member 28, and a longitudinal extension slot 27 extending from the plate end aperture 23 to the handle aperture 25 and continuing to a lateral side wall 21 to removably receive the extension portion 30 of the arm member 16, thereby promoting the insertion of the plate end 18 and the extension portion 30 through each weight member 28 vertically aligned upon a base plate 12.

Figure 3:
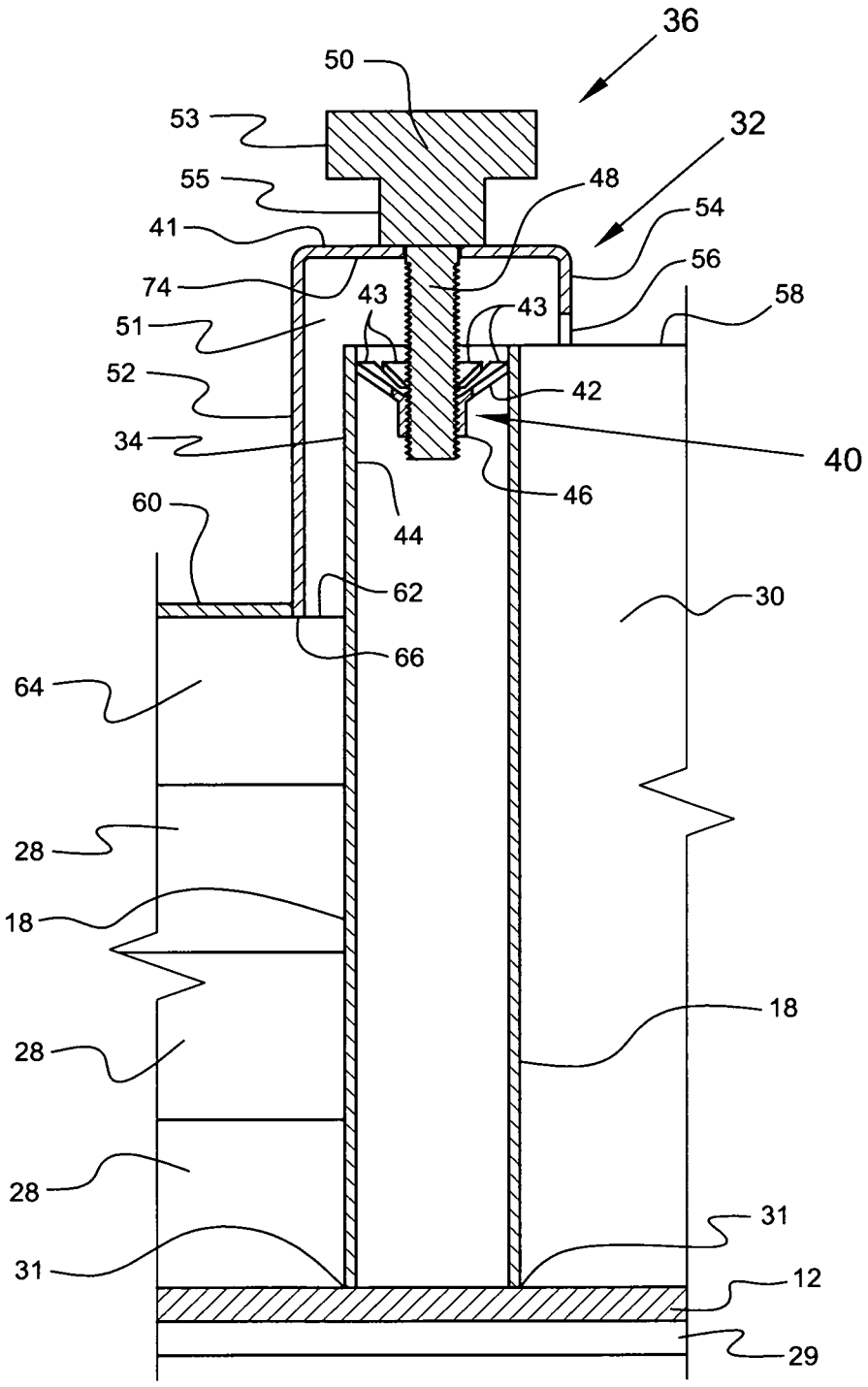
FIG. 3 is a front elevation-sectional view of the weight retaining member secured to a knob retaining member in the plate end of the arm member of FIG. 2, but with the weight members removed from an extension portion of the arm member.
Figure 4:
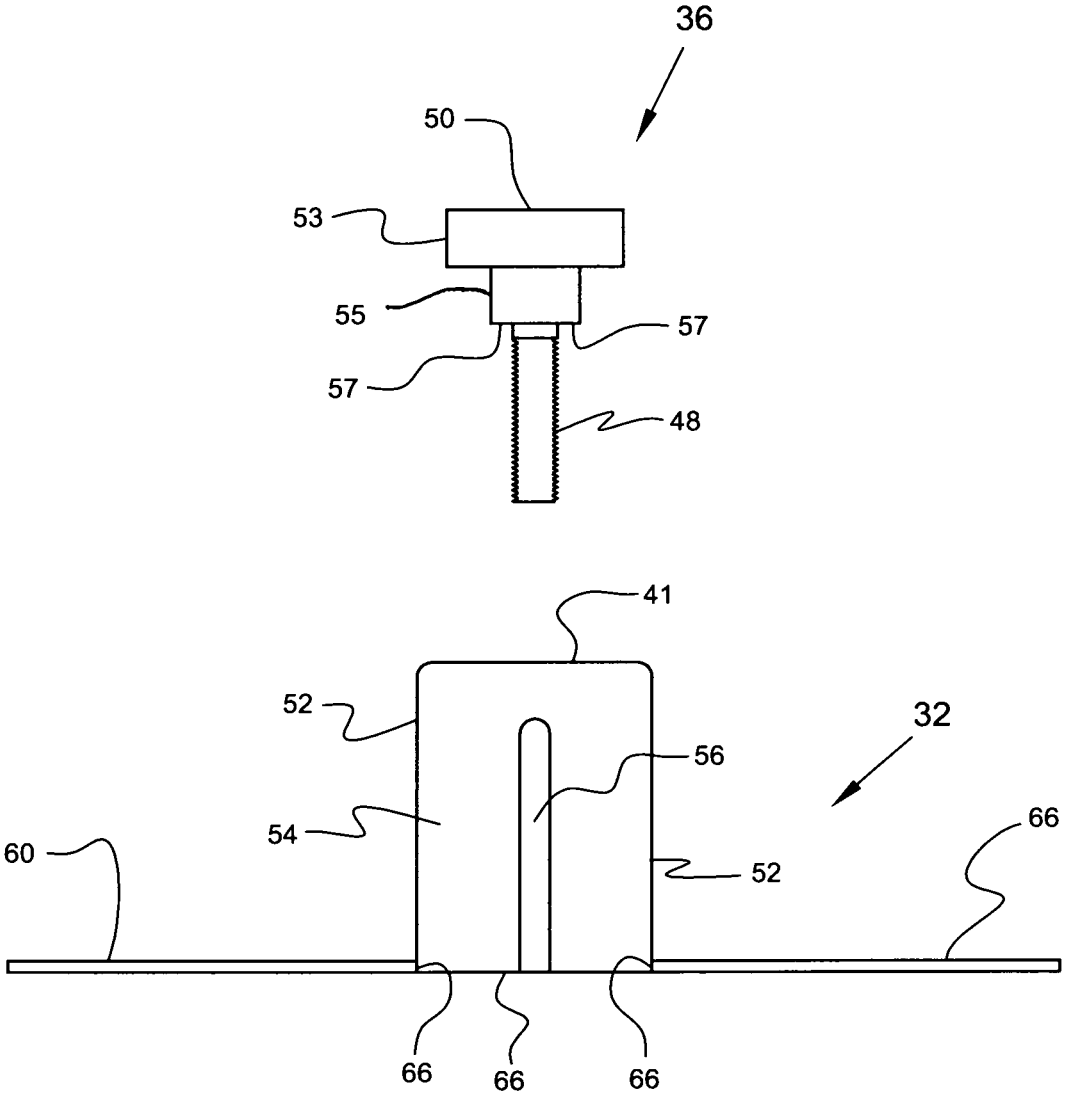
FIG. 4 is a front elevation view of the weight retaining member with a separated knob member of FIG. 3.
Figure 5:
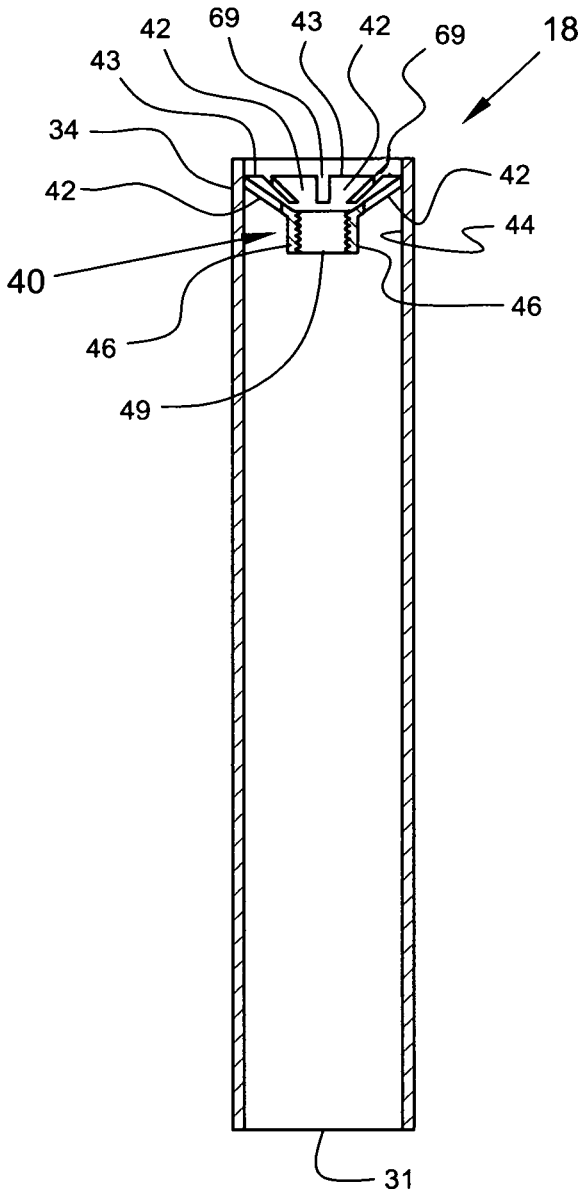
FIG. 5 is a front sectional view of the plate end of an arm member with a knob retaining member integrally secured in an inner portion of a top end portion of the plate end of an arm member of FIG. 3.
Figure 6:
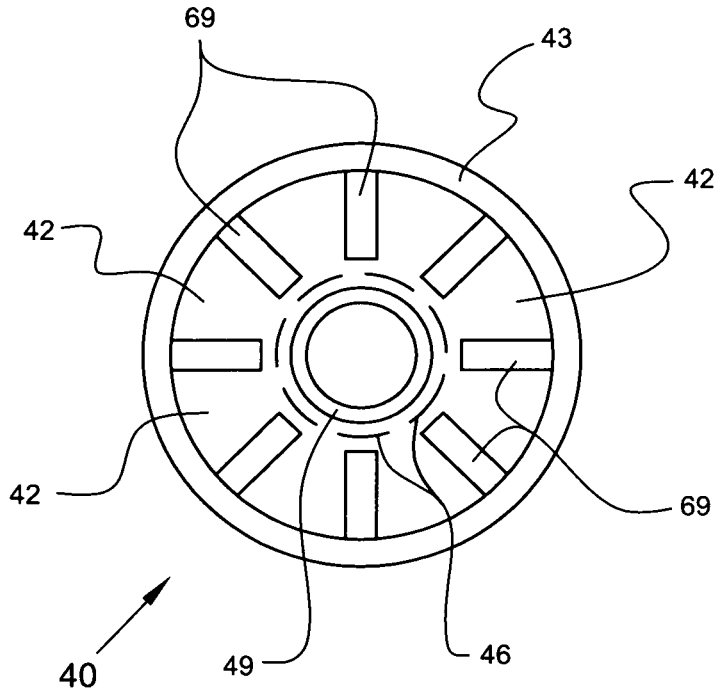
FIG. 6 is a top elevation view of the knob retaining member of FIG. 5.

Referring to FIGS. 3 and 4, the weight retaining member 32 includes a relatively cube configuration having a cavity 51 formed via three planar side walls 52 and a fourth planar side wall 54 with a longitudinal slot 56 for vertically receiving a top edge portion 58 of the extension portion 30 of the arm member 16 when the device 10 is disposed on a structure. The weight retaining member 32 further includes three securing arms 60 that ultimately engage a top wall 62 of a top weight member 64. The securing arms 60 are substantially flat, light weight, rigid, metal plates having longitudinal dimensions relative longer than the arms 60 lateral dimension. The securing arms 60 distribute a holding force across the top wall 62 of each of the top weights 64 to promote vertical alignment of a plurality of the weight members 28 and to secure the plurality of weight members 28 upon the base plates 12 when a sufficient manual force has been rotationally urged upon the knob member 36. Although the arms 60 are depicted as "strips" of rigid metal, a myriad of metal plate configurations can be used to replace the arms 60 and secure the weight members 28 to the base plates 12, including but not limited to disc and square configurations having a relatively large bottom wall that engages the top wall 62 of the top weight 64, thereby providing increased compressive force upon the stacked weight members 28 that maintains the stacked weight members 28 in a vertically aligned arrangement as the handle portion 50 of the knob member 36 is rotationally urged into forcible engagement with the top wall 41 of the weight retaining member 32.

The slots 56 of the weight retaining members 32 snugly and slidably receive the top edge 58 of a respective extension portion 30 when the members 32 are manually urged downward upon the substantially vertically positioned extension portion 30. The weight retaining members 32 are manually urged downward when the shank portion 48 of the knob member 36 is rotationally inserted through the weight retaining member 32 and into the knob retaining member 40. The handle portion 50 of the knob member 32 forcibly urges the weight retaining member 32 in a vertically downward direction upon the extension portion 30 weight members 28 due to the extension portion 30 guiding and stabilizing the vertical downward movement of the weight retaining member 32, via the slot 56, when a relatively large manual force is rotationally imparted upon the weight retaining member 32 via the handle portion 50.

The extension portions 30 stabilize the vertical movement of the weight retaining members 32 until a bottom edge portion 66 of the weight retaining member 32 engages a top wall 62 of a top weight 64, resulting in the extension portion 30 "filling" the slot 56 until a relatively small portion of the slot 56 remains (see FIG. 3). The vertical dimension of the remaining slot portion 56 is the maximum downward vertical distance the weight retaining member 32 can travel before engaging the top edge portion 58 of the extension portion 30, thereby preventing the bottom edge 66 of the weight retaining members 32 from engaging a top wall 62 of a top weight member 64 in the event that a predetermined quantity of weight members 28 have been reduced to an unacceptable quantity that correspondingly reduces the gripping force generated by rubber bottom grip 29 of the base plates 12 upon the supporting structure, resulting in an "unsafe" condition for the user "connected" to the device 10.

The configurations and dimensions of the hub member 14, arm member 16, plate end 18, weight members 28, weight retaining member 32, knob member 36 and/or the knob retaining member 40, can be adjusted to secure a minimum number of weight members 28 upon the base plates 12. If the quantity of weight members 28 disposed upon the base plate 12 is three instead of four (for example, see FIG. 3), due to the "thickness" of each weight member 28 being greater than the distance between a bottom wall 74 of the weight retaining member 32 and a top edge 58 of the extension portion 30, and a top edge of the plate end 18; the bottom wall 74 will engage the edge 58 of the extension portion 30 and the top edge of the plate end 18 before the securing arms 60 and the bottom edge portion 66 of the weight retaining member 32 engage the top wall 62 of the top weight member 64, resulting in none of the weight members 28 being secured by the weight retaining member 32 to the respective base plate 12. This is an unacceptable condition that will prevent the use of the device 10 until a fourth weight member 64 is added to the stack of three weight members 28 to enable the respective weight retaining member 32 to engage the top wall 62 of the top (or fourth) weight member 64 and secure all four weight members 28 to the respective base plate 12.

Preventing the bottom edge 66 of one or more of the weight retaining members 32 from engaging a top wall 62 of a top weight 64 defeats the safety purpose for using the device 10 and causes the device 10 to become ineffective to prevent a person wearing a harness having a strap detachably secured to the hub member 14 from falling from the preselected structure and engaging a lower elevation surface. The device 10 cannot be used when a required quantity of weight members 28 are not disposed upon and secured to the base plates 12. The requirements for operating the device 10 safely, including the minimum quantity of weight members 28 to be secured upon the base plates 12, are displayed as warnings on multiple portions of the device 10.

The knob retaining member 40 includes a funnel configured shank receiving portion 42 having a central orifice portion 46 with a threaded inner cylindrical wall 49 that rotationally receives the threaded shank portion 48 of the knob member 36. The shank receiving portion 42 includes an outer edge portion 43 that is integrally secured, via welding or similar means, to an inner portion 44 of the top end portion 34 of the plate end 18 of the arm member 16. The funnel configured shank receiving portion 42 guides the shank portion 48 into the threaded orifice portion 46 as the shank portion 48 is manually inserted though the non-threaded orifice 37 in the top wall 41 of the weight retaining member 32; whereupon, the shank portion 48 is rotationally inserted into the threaded orifice 46 until the weight retaining member 32 is secured upon the top wall 62 of the top weight 64. A handle portion 50 of the knob member 36 forcibly engages the top wall 41 of the weight retaining member 32, resulting in the handle portion 50 forcibly urging the weight retaining member 32 and the securing arms 60 integrally joined to the bottom edge portion 66 of the engagement member 32 into the top wall 62 of the top weight 60.

The handle portion 50 is configured is configured to impart a relatively large rotational manual force upon the weight retaining member 32 and correspondingly upon the plurality of weight members 28 and the base plates 12 to maintain the relative positions of the hub member 14 and base plates 12 upon a structure such that a person wearing a harness secured to the hub portion is prevented from falling from the structure and engaging a lower elevation surface. The handle portion 50 configuration includes a grasping portion 53 and a finger portion 55 for maintaining a space for the user's fingers between the grasping portion 53 and the top wall 41 of the weight retaining member 32 as the user forcibly rotates the handle portion 50 with the bottom wall 57 of the finger portion 53 constantly engaging the top wall 41 of the weight retaining member 32, thereby forcibly inserting the shank portion 48 of the knob member 36 into the "non-rotatable" knob retaining member 40; resulting in the weight retaining member 32 forcibly urging the top weight member 64 of the plurality of weight members 28 into respective base plates 12 to maintain the position of the hub member 14 upon an elevated structure to prevent a person from falling upon a lower elevation structure in the event that person, secured to the hub member 14, should fall from the elevated structure.

The funnel configured shank receiving portion 42 of the knob retaining member 40 further includes a plurality of water draining apertures 69 to promote the draining of water that may accumulate in the plate end 18 of the arm member 16 during normal operation of the device. The water draining apertures 69 promote water removal when the arm member 16 is inverted such that the base plate 12 is the "top" element relative to the arm member 16, and the funnel portion 42 is vertically above the orifice portion 46.

Although the funnel configuration for the knob retaining member 40 is preferred, a myriad of configurations for the knob retaining member 40 can be used, including but not limited to a substantially disc shaped knob retaining member 40 with a centrally disposed threaded orifice for receiving the threaded shank portion 48 of the knob member 36; and a relatively "thin" substantially square configured member 40 integrally joined to the inner portion 44 of the top end portion 34 of the plate end 18 of the arm member 16, the square member 40 having a centrally disposed threaded orifice for receiving the threaded shank portion 48 of the knob member 36.

Another alternative knob retaining member 40 configuration that could be removably inserted into the plate end 18 of the arm member 16 is a substantially square configured member 40 slidably inserted into a lateral slot (not depicted) in the top end portion 34 of the plate end 18. The slidably inserted square configured member 40 would be supported by inner rails (not depicted) disposed to cooperate with the slot to support the knob retaining member 40 perpendicularly to a central axis of the plate end 18, such that a threaded central orifice of the slidably inserted knob retaining member 40 is axially aligned with the central axis of the plate end 18. The slidably inserted member 40 requires a square configured plate end 18 to prevent the inserted member 40 from rotating as the shank portion 48 of the knob member 36 is forcibly rotated to insert into the threaded central orifice of the member 40. The inserted member 40 snugly inserts into the slot and interior of the square configured plate end 18, thereby locking the position of the member 40 relative to the interior of the square configured plate end 18 and preventing the member 40 from rotating inside the plate end 18.

The knob member 36 ultimately promotes a manual force upon each weight retaining member 32, which correspondingly urges the manually force upon vertically stacked weight members 28, such that the vertically stacked weight members 28 are "squeezed" between the weight retaining members 32 and the top wall 35 of respective base plates 12, thereby detachably securing the weight members 28 to the base plates 12; whereby, a person wearing a harness (not depicted) can secure the harness to a loop portion 38 of the hub member 14 of the device 10 and prevent a person from falling from the preselected structure to a lower elevation surface (not depicted). A plurality of reinforcement plates 47 are integrally and perpendicularly secured to the top wall 70 of the base portion 26 of the hub member 14. The reinforcement plates 47 are also secured to the loop portion 38 to prevent the loop portion 38 from deforming when the loop portion 38 is manually grasped and elevated to ultimately be positioned on a structure.

When the device 10 is disposed upon a structure, arm members 16 are radially spaced apart and equal distance to promote an equal distribution of weight and corresponding holding force generated by the rubber bottom grips 29 upon the structure. To maintain the equal radial spacing of the arm members 16, a pair of relatively small vertically positioned parallel metal holding plates 68 are integrally joined to a top wall 70 of the base plate 26 of the hub member 14, such that a lower edge portion 72 of the extension portion 30 snugly inserts between the holding plates 68, thereby maintaining the separation between adjacent arm members 16 and the base plates 12 integrally joined to the arm members, and maintaining the position of the arm members 16 relative to the hub member 14.

As an alternative to the vertically disposed holding plates 68, square configured channels, when taking a top view of the channel, can be used to replace the cylindrically configured hub ends 22 of the arm members 16 and to replace the hub pipe members 24 such that the hub ends 22 snugly insert upon the hub pipe members 24, thereby restricting rotational movement between the hub ends and the hub pipe members 24, resulting in the maintaining of the positions of the arm members 16 relative to the hub member 14, and the maintaining of the distance of separation between adjacent arm members 16.

The invention claimed is:

1. A single man tie-off anchor device having manually secured weight members comprising:

at least one base plate detachably secured to a hub portion, said at least one base plate having a predetermined quantity of weight members detachably secured to said at least one base plate, said hub portion and said at least one base plate being disposed upon a preselected structure;

an arm member having a plate end perpendicularly secured to a top wall of said at least one base plate, said arm member having a hub end detachably secured to a hub conduit member of said hub portion, said arm member having an extension portion integrally joined to said plate end and said hub end;

a knob retaining member secured to an inner portion of a top end portion of said plate end of said arm member;

a weight retaining member detachably secured to said knob retaining member, said weight retaining member detachably securing a predetermined quantity of weight members to said at least one base plate; and a knob member for manually securing said weight retaining member to said knob retaining member such that said weight retaining member engages a top wall of a top weight member, thereby detachably securing a predetermined quantity of weight members upon the top wall of said at least one base plate; whereby, a person wearing a harness can secure the harness to said hub portion of said device and prevent the person from falling from the preselected structure and engaging a lower elevation surface.

2. The device of claim 1 wherein the configurations and dimensions of said plate end, weight members, and weight retaining member, cooperate to prevent the securing of said weight members upon said base plate when a minimum quantity of weight members are not disposed upon said base plates.

3. The device of claim 1 wherein said base plates include a deformable material attached to a bottom wall of said base plates for maintaining the position of said base plates upon a surface portion of the preselected structure.

4. The device of claim 1 wherein said plate end of said arm member includes a conduit perpendicularly secured to a center portion of said at least one base plate.

5. The device of claim 1 wherein said plate end of said arm member includes a channel having a square configuration when taking a top view of said at least one base plate.

6. The device of claim 1 wherein said knob retaining member includes a funnel configured shank receiving portion having a central orifice portion with a threaded inner cylindrical wall that receives a rotating threaded shank portion of said knob member.

7. The device of claim 6 wherein said shank receiving portion includes an outer edge portion integrally secured to an inner portion of a top end portion of said plate end of said arm member, said funnel configured shank receiving portion ultimately guiding said shank portion into said threaded orifice portion as said shank portion is manually inserted through a non-threaded orifice in a top wall of said weight retaining member; whereupon, said shank portion is rotationally inserted into said threaded orifice until said weight retaining member is secured upon the top wall of the top weight member.

8. The device of claim 7 wherein said knob member includes a handle portion that forcibly engages said top wall of said weight retaining member, resulting in said handle portion forcibly urging said weight retaining member and at least one securing arm integrally joined to a bottom edge portion of said weight retaining member into said top wall of said top weight member, thereby transferring manual force from said handle portion to said weight retaining member and into the top weight member and correspondingly compressing all weight members between said weight retaining member and said at least one base plate.

9. The device of claim 6 wherein said knob retaining member includes at least one drain aperture to allow water to drain from said plate end of said arm member when said at least one base plate is inverted.

10. The device of claim 1 wherein said knob retaining member includes a substantially disc configuration having a centrally disposed threaded orifice for receiving a threaded shank portion of said knob member.

11. The device of claim 1 wherein said knob retaining member includes a substantially square configuration having a centrally disposed threaded orifice for receiving a threaded shank portion of said knob member.

12. The device of claim 1 wherein said weight retaining member includes at least one securing arm member for engaging a top wall of said top weight member, said at least one securing arm member distributing a holding force across said top wall of said top weight member to promote vertical alignment of a plurality of weight members and to secure said plurality of weight members upon said at least one base plate when a sufficient manual force has been rotationally urged upon said knob member.

13. The device of claim 1 wherein said knob member is configured to promote a relatively large manual force to be rotationally imparted upon said weight retaining member and correspondingly upon said plurality of weight members and said base plate to maintain the relative positions of said hub portion, said weight members, and said at least one base plate upon the structure such that a person wearing a harness secured to said hub portion is prevented from falling from the structure and engaging the lower elevation surface.

14. A single man tie-off anchor device having manually secured weight members comprising:

a plurality of base plates detachably secured to a hub portion, said plurality of base plates having a predetermined quantity of weight members detachably secured each of said plurality of base plates, said hub portion and said plurality of base plates being disposed upon a preselected structure;

a plurality of arm members each having a plate end perpendicularly secured to a top wall of each of said plurality of base plates, each of said arm members having a hub end detachably secured to a hub conduit member of said hub portion, each of said arm members having an extension portion integrally joined to each of said plate ends and said hub ends;

a plurality of knob retaining members secured to an inner portion of a top end portion of each of said plurality of plate ends of said plurality of arm members;

a plurality of weight retaining members detachably secured to said plurality of knob retaining members, said plurality of weight retaining members detachably securing a predetermined quantity of weight members to said plurality of base plates;

a combination of configurations and dimensions of said plate ends, said extension portions, said weight members and said weight retaining members that cooperate to prevent the securing of said weight members upon said base plates when a minimum quantity of weight members are not disposed upon said base plates; and a plurality of knob members for manually securing said plurality of weight retaining members to said plurality of knob retaining members such that said weight retaining members engage top walls of top weight members, thereby detachably securing a predetermined quantity of weight members upon the top wall of each of said plurality of base plates; whereby, a person wearing a harness can secure the harness to said hub portion of said device and prevent the person from falling from the preselected structure and engaging a lower elevation surface.

15. A device for manually securing weight members to a tie-off anchor disposed on an elevated structure to prevent a person from falling from the elevated structure and upon a lower elevation structure comprising:

a knob retaining member secured to an inner portion of a top end portion of a plate end of an arm member detachably secured to a hub member, the hub member disposed upon a structure and providing a loop member for removably receiving a strap secured to a harness worn by a user of the device to prevent the user from falling from the elevated structure and upon the lower elevation structure;

a weight retaining member detachably secured to said knob retaining member, said weight retaining member detachably securing a predetermined quantity of weight members to at least one base plate disposed upon the structure, the at one least one base plate being detachably secured to the hub member, said weight retaining member including a longitudinal slot that cooperates with said arm member to prevent the securing of weight members upon said base plate when a minimum quantity of weight members are not disposed upon said base plate; and a knob member for manually securing said weight retaining member to said knob retaining member such that said weight retaining member engages a top wall of a top weight member, thereby detachably securing a predetermined quantity of weight members upon a top wall of the at least one base plate; whereby, a person wearing a harness can secure the harness to said hub portion of said device and prevent the person from falling from the preselected structure and engaging the lower elevation surface.

16. The device of claim 15 wherein said knob retaining member includes a funnel configured shank receiving portion having a central orifice portion with a threaded inner cylindrical wall that receives a rotating threaded shank portion of said knob member, said shank receiving portion including an outer edge portion integrally secured to the inner portion of the top end portion of said plate end of said arm member, said funnel configured shank receiving portion ultimately guiding said shank portion into said threaded orifice portion as said shank portion is manually inserted through a non-threaded orifice in a top wall of said weight retaining member; whereupon, said shank portion is rotationally inserted into said threaded orifice until said weight retaining member is secured upon the top wall of the top weight member.

17. The device of claim 15 wherein said knob member includes a handle portion having a configuration that includes a grasping portion and a finger portion for maintaining a space for the user's fingers between the grasping portion and a top wall of said weight retaining member as the user forcibly rotates said handle portion with a bottom wall of said finger portion constantly engaging said top wall of said weight retaining member, thereby forcibly inserting a shank portion of said knob member into said knob retaining member; resulting in said weight retaining member forcibly urging the top weight member of the plurality of weight members into respective base plates to maintain the position of the hub member upon the elevated structure to prevent a person from falling upon the lower elevation structure in the event that person, secured to the hub member, should fall from the elevated structure.

* * * * *